US006431690B1

(12) United States Patent
Shinkai et al.

(10) Patent No.: US 6,431,690 B1
(45) Date of Patent: Aug. 13, 2002

(54) INK JET HEAD AND PRODUCING PROCESS THEREFOR

(75) Inventors: Yuji Shinkai, Kounan; Naohiko Tani; Tsuyoshi Eguchi, both of Nagoya, all of (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/534,027

(22) Filed: Mar. 24, 2000

(30) Foreign Application Priority Data

Mar. 26, 1999 (JP) ..... 11-083432
Jul. 8, 1999 (JP) ..... 11-194519

(51) Int. Cl.[7] ..... B41J 2/045
(52) U.S. Cl. ..... 347/68
(58) Field of Search ..... 347/68, 69, 79, 347/71, 63, 58

(56) References Cited

U.S. PATENT DOCUMENTS 5,754,203 A * 5/1998 Kinoshita ..... 347/69
5,912,684 A * 6/1999 Fuji et al. ..... 347/54
5,914,739 A 6/1999 Zhang

* cited by examiner

*Primary Examiner*—John Barlow
*Assistant Examiner*—Michael S Brooke
(74) *Attorney, Agent, or Firm*—Oliff & Berridge, PLC

(57) ABSTRACT

In an ink jet head according to the invention, an electrode provided on an actuator board has two-layer structure. A first layer is made of a noble metal such as palladium containing phosphorus or boron with a property of being able to form a layer directly on a piezoelectric element of the actuator board, such as PZT. A second layer, to be formed on the first layer, is made of a noble metal the same kind of metal used for the first layer and with high degree of purity close to 100%. This structure improves corrosion resistance to ink, eliminates the necessity to form a conventional protective layer, and leads to reductions of the manufacturing steps and costs.

19 Claims, 7 Drawing Sheets

INK JET HEAD AND PRODUCING PROCESS THEREFOR

BACKGROUND OF THE INVENTION

1. Field of Invention

The invention relates to an ink jet head that records characters and figures using ink ejecting from nozzles and a method for producing the ink jet head.

2. Description of Related Art

Generally, an ink jet head has a plurality of ejection channels connected to nozzles. Ink is supplied to the channels. When a piezoelectric material defining the channels are deformed or ink is heated locally for vaporization, pressure is applied to ink in the channels, which causes ink to jet out from the nozzles.

For such an ink jet head, the piezoelectric material such as lead zirconium titanate, PZT is used for an actuator board having a plurality of channels disposed in parallel. The voltage is selectively applied to an electrode provided on a side wall of each channel, causing deformation of the side wall. (Refer to Japanese laid-open Patent Publication No.7-304178.)

To produce the above ink jet head, the actuator board made of the piezoelectric material is formed with a plurality of channels all cut in parallel to an equal depth. A conductive layer is formed on the entire surfaces of the actuator board including the inside of the channels by electroless plating. The conductive layer is divided according to the channels by grinding or laser processing, to form a plurality of electrodes and connecting terminals. The electrodes of the conductive layer are formed on the side walls of each channel, whereas the connecting terminals for connecting an electrode to a pattern cable on a board, such as a flexible printed circuit board, are formed on a surface opposite to the surface where the channels are formed. One of the connecting terminals is connected to a driving control part of the ink jet head recording device. In this arrangement, the driving control part outputs a voltage based on record data. The voltage is applied to the electrodes in each channel via pattern cable and contacting terminals, which deforms the side walls and causes the ink in each channel to jet out from the nozzles.

In this kind of ink jet head, a nickel layer, as the conductive layer (electrodes), is formed on all surfaces of the actuator board made of the piezoelectric material by electroless plating, and gold is plated on the nickel layer so as to aid soldering a pattern cable. Nickel has some degree of anti-corrosion against ink, but it is not enough. Gold on nickel facilitates to ionize nickel and serves as a protective layer to prevent the nickel layer from corroding.

However, in this manner, manufacturing steps are increased, and manufacturing costs are raised.

SUMMARY OF THE INVENTION

The invention provides an ink jet head having an improved corrosion resistance to ink and less workload, such as heat generation, at the driving control part, and a method of producing such ink jet head, while reducing manufacturing costs. The invention also provides an inexpensive ink jet head that can work at a lower voltage.

Specifically, the invention provides an ink jet head that may include an actuator board formed with a plurality of ejection channels for jetting ink droplets out therefrom, and a plurality of electrodes provided on the actuator board so as to give jet energy to ink in channels. Each of the electrodes may include a first layer made of a noble metal having a property of being formable directly on the actuator board and a second layer that includes the noble metal with a lower electrical resistance, the second layer being formed on the first layer.

The material used for the first layer has a property of being able to adhere directly to a piezoelectric element of the actuator board, such as PZT, but its resistance is comparatively large. On the other hand, the electrical resistance of the material used for the second layer is smaller than that for the first layer. Further, the material of the second layer is difficult to be formed on the piezoelectric element directly, but is easy to be formed on a noble metal containing phosphorus or boron. The invention enables the formation of a two-layer electrode by ingeniously making use of the properties of these two materials. This two-layer structure improves corrosion resistance to ink, and eliminates the necessity to form a conventional protective layer. Therefore, the number of manufacturing processes and costs can be reduced.

In addition, pattern cables are connected to the second layer of low resistance, enabling reduction of the workload at the driving control part. If the layers of the electrode are made of different metals, it may cause a difference in electric potential between the two layers, which are easily susceptible to corrosion. However, the invention uses the same metal for the two layers, and such problem can be resolved.

In a preferred aspect of the invention, the first layer is made of palladium and may include at least one selected from the group consisting of phosphorus and boron, and the second layer is made of pure palladium with a high purity of approximately 99.5% or more. In this arrangement, palladium containing phosphorus has a property of being able to adhere to the actuator board made of PZT. Therefore, it is used for the first layer that can be formed directly on the actuator board. Palladium not containing phosphorus is difficult to be formed directly on the actuator board, but is easy to adhere to the first layer that is made of palladium containing phosphorus. Better still, palladium has high corrosion resistance to ink and is of lower resistance, therefore, it is advantageous as a terminal electrode for connecting the driving control part.

In another preferred aspect of the invention, the actuator board forms a catalyst metal particle layer thereon, and the first layer is formed on the catalyst metal particle layer. The catalyst layer is, for example, comprised of a tin ion particle layer and a palladium particle layer by precipitation. This precipitation of the catalyst layer facilitates forming the first layer made of palladium containing phosphorus as a plating layer by precipitation.

In a further preferred aspect of the invention, the first layer is formed by electroless plating or physical vapor deposition, and the second layer is formed by electroless plating, electroplating, or physical vapor deposition. The first layer can be easily formed on the actuator board because electroless plating or physical vapor deposition is performed in or using a liquid of palladium containing phosphorus. The second layer can be also easily formed on the first layer because electroless plating, electroplating or physical vapor deposition is performed in or using a liquid of palladium containing no phosphorus. Since the actuator is coated with PZT, the second layer can not be precipitated without the formation of the first layer because lead included in PZT is a catalytic poison. On the other hand, when the first layer is formed on the actuator board, lead of PZT is covered and the second layer is precipitated.

In another preferred aspect of the invention, the ejection channels of the actuator board are defined with walls of a piezoelectric material electrically polarized in at least one part, the electrodes are formed on sides of the walls, and the ink jet head may further include: a connecting terminal to connect each electrode formed on a surface of the actuator board opposite to the surface of the ejection channels to a signal source. In this arrangement, the conductive layer can be formed continuously from the ejection side to the opposite side of the actuator board, and consequently it is readily formable.

In a further preferred aspect of the invention, a process of producing an ink jet head, the process may include the steps of forming a plurality of channels in an actuator board, and forming a conductive layer on the actuator board, dividing the conductive layer into a plurality of electrodes that correspond to each channel. The step of forming the conductive layer may include the steps of forming a first layer made of a noble metal having a property of being formable directly on the actuator board, and forming a second layer that includes the noble metal with a lower resistance on the first layer. In this process, the conductive layer of the first layer is formed on the entire surface of the actuator board having channels including the ejection channels. The conductive layer of the second layer is formed on the first layer similarly. Then, these conductive layers are divided to easily turn to the electrodes corresponding to the ejection channels on the actuator board. The electrodes are formed by radiation of a laser or a plasma process.

The invention provides an ink jet head that may include an actuator board having a plurality of channels defined by side walls made of a piezoelectric material electrically polarized in at least one part, the channels each having an open face disposed in a longitudinal direction; an electrode formed on a surface of the side walls parallel to a polarized direction, the electrode generating an electric field orthogonal to the polarized direction so as to deform the side walls in a direction of the channel width, and a cover plate that covers the open faces of the channels, the cover plate being fixed to the side walls. The cover plate may be made of one selected from the group consisting of forsterite and beryllia. In this arrangement, when the voltage is applied to the electrode on the side walls, an electric field, whose electric force is orthogonal to the polarized directions, is generated, the side walls are deformed in the direction of the width of the channel to increase volume in the ejection channel surrounded by the side walls, and ink droplets are jetted out. When the side walls are deformed in the direction of the width of the channel, a reaction to the cover plate is triggered. However, the cover plate may be made of forsterite ($2MgO \cdot SiO_2$) or beryllia (BeO) whose Young's modulus is higher than that of the piezoelectric material used for the side walls. These materials prevent the side walls from deforming due to the reaction, allowing an expected ink jet pressure to be obtained. The expected ink jet pressure can be obtained at a lower voltage compared to the conventional one, and the structure related to the electrical mechanism can be generated inexpensively.

Comparing to PZT or PT, forsterite and beryllia have high Young's modulus and are inexpensive. Therefore, the ink jet head can be provided inexpensively. In addition, forsterite contributes to weight saving of the ink jet head because it is light.

BRIEF DESCRIPTION OF THE DRAWINGS

The invention will be described in greater detail with reference to preferred embodiments thereof and the accompanying drawings wherein.

DETAILED DESCRIPTION OF PREFERRED EMBODIMENTS

One preferred embodiment of the invention will be described in detail with reference to the accompanying drawings.

Figure 1:
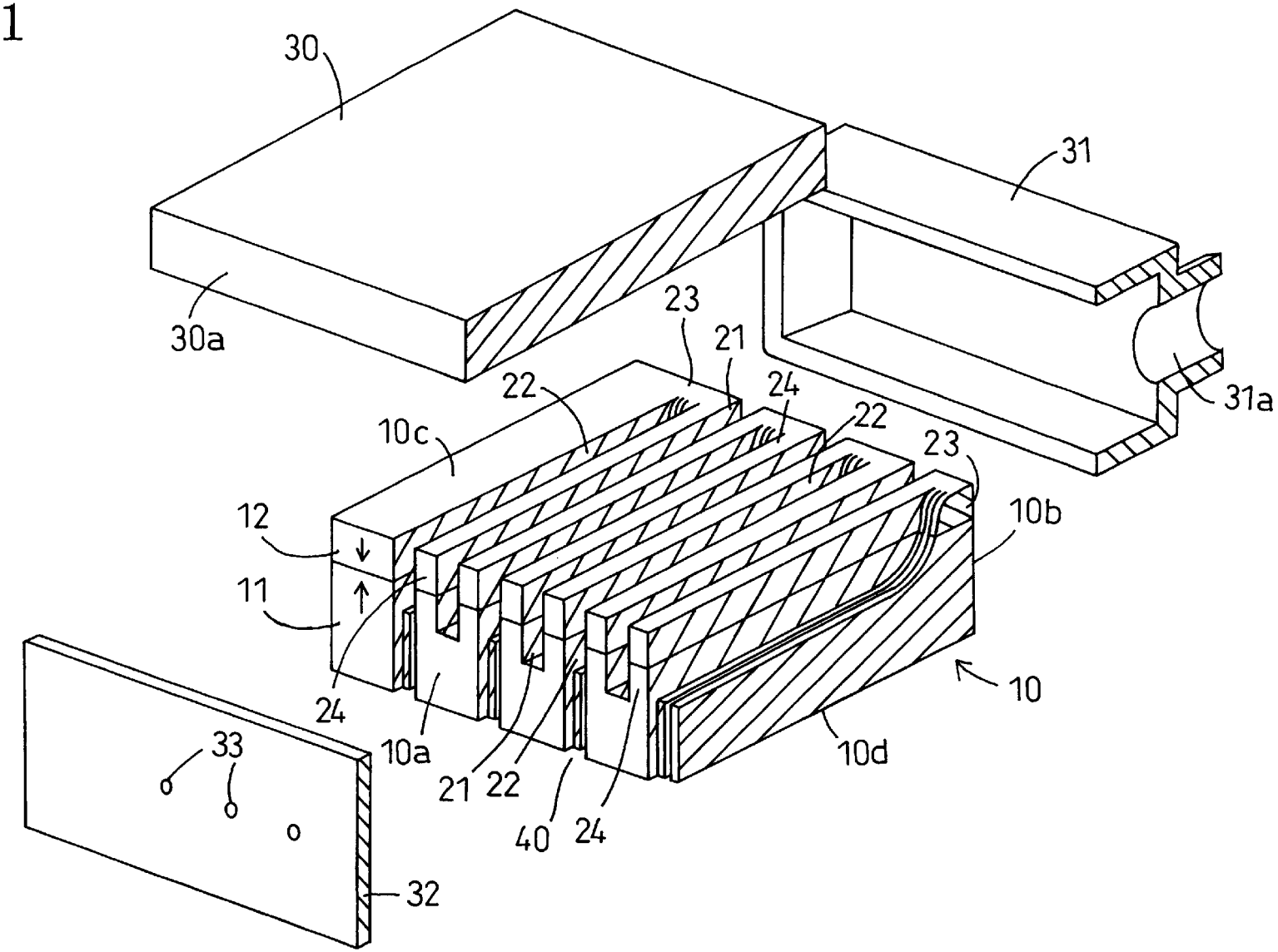
FIG. 1 is an exploded view of an ink jet head to be described in an embodiment of the invention.
Figure 2:
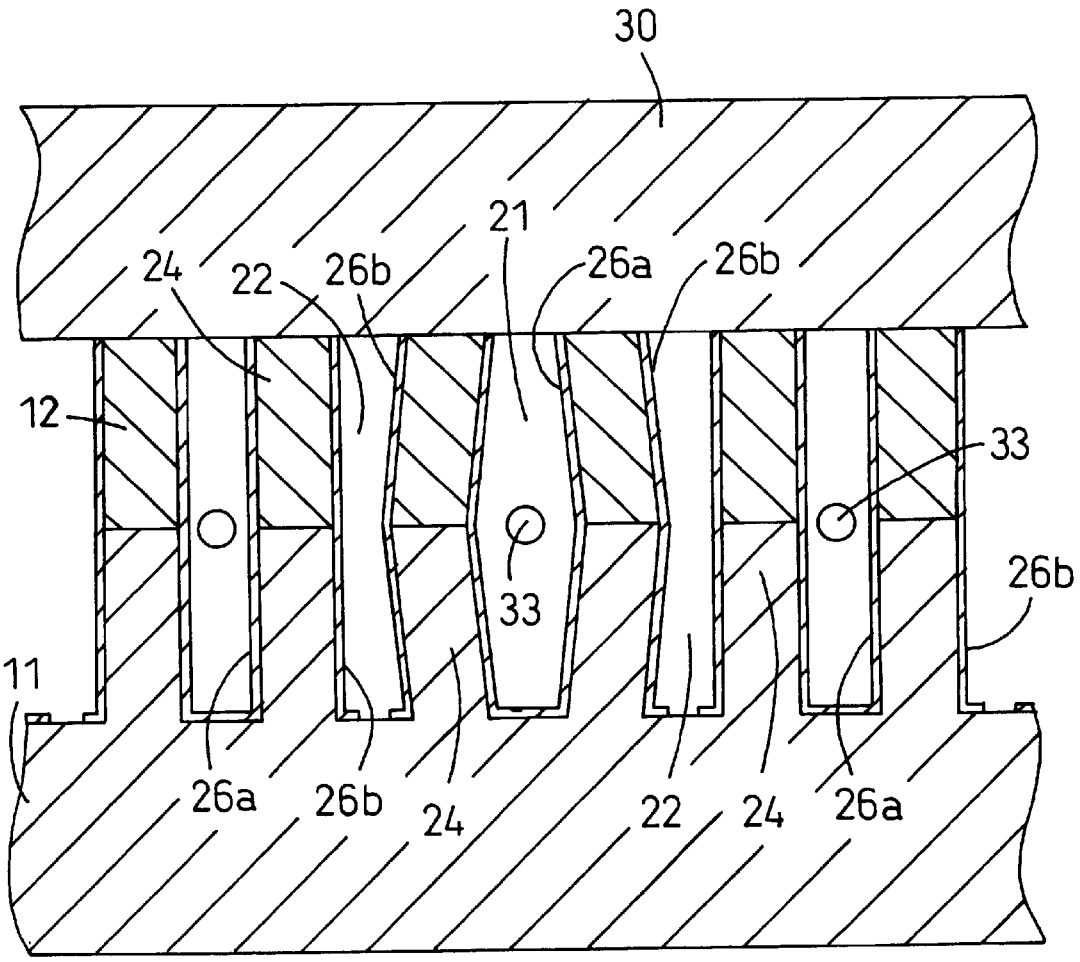
FIG. 2 is a longitudinal sectional view of the ink jet head.
Figure 3:
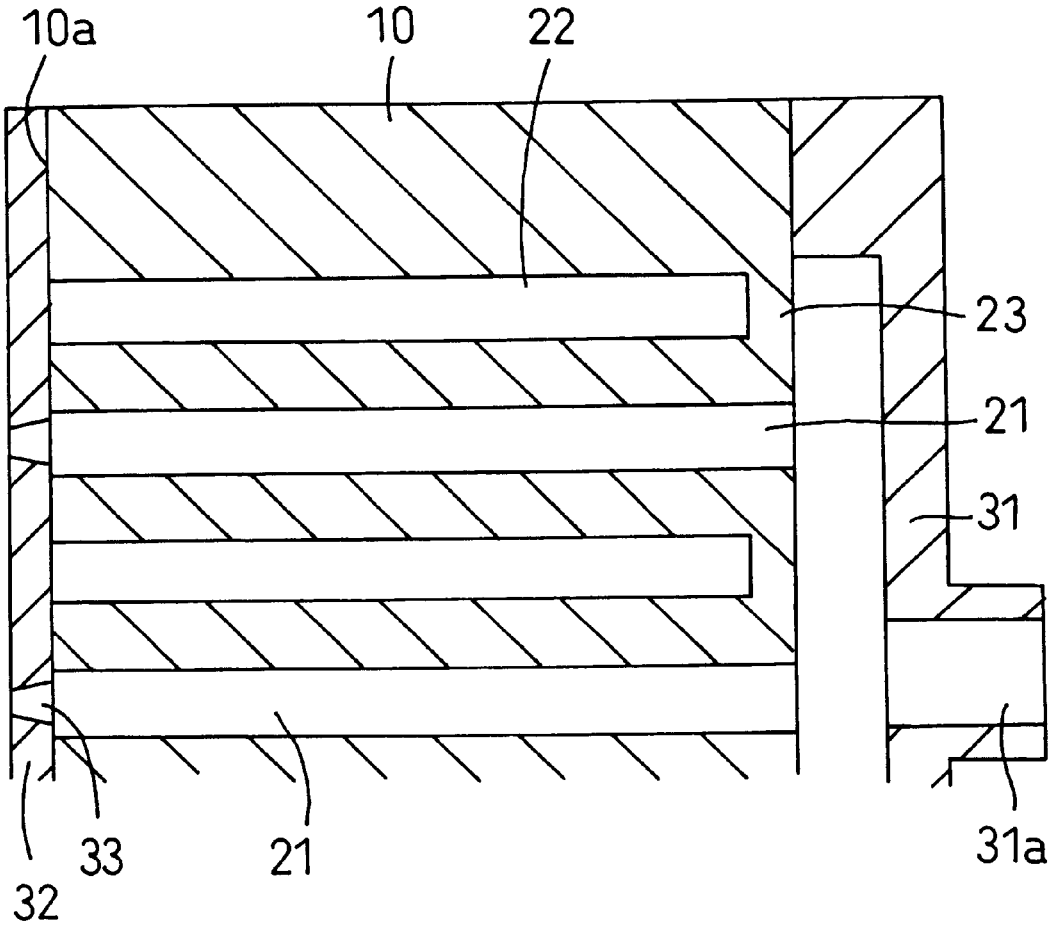
FIG. 3 is a transverse sectional view of the ink jet head.

FIG. 1 shows an exploded view of an ink jet head. FIG. 2 is a longitudinal sectional view of the ink jet head, and FIG. 3 is a transverse sectional view of the ink jet head. The ink jet head has an actuator board 10, a cover plate 30, a nozzle plate 32, and a manifold 31. The actuator board 10 is provided with a plurality of piezoelectric materials 11, 12 made of ceramics of lead zirconate titanate (PZT) or lead titanate (PT), which are stacked and adhered. The piezoelectric materials 11, 12 are electrically polarized in opposite directions each other (in directions of a thickness of the actuator board 10 indicated by arrows). On the top of the actuator board 10, formed are a plurality of channels 21, 22 which are hollowed out into both materials. Of the channels, ejection channels 21 are placed every other channel to jet ink droplets, and dummy channels 22, are disposed at both ends of the actuator board 10 and between the ejection channels 21.

Each of the ejection channels 21 is cut through the actuator board 10 completely from the front end 10*a* to the rear end 10*b* of the actuator board 10 with a fixed depth. Each of the dummy channels 22 is open at the front end 10*a*, curved up slowly toward the back end 10, and closed at the rear end 10*b*, so as to align with the top surface of the actuator board 10. On the front end of the actuator board 10, vertical grooves 40 are formed corresponding to each of the dummy channels 22. The ejection channels 21 and the dummy channels 22 are disposed horizontally and alternately via the side walls 24. The side walls 24 are also made of a plural layers of piezoelectric materials 11, 12 electrically polarized in opposite directions. One ejection channel 21 and the neighboring two walls 24 on both sides of the ejection channel 21 act as an actuator.

The cover plate 30 made of ceramics or resin is bonded to the top of the actuator board 10 with an epoxy-based adhesive so as to seal against leakage. This closes the uncovered tops of channels 21, 22. Therefore, the channels 21 are open at front and rear ends, and the dummy channels 22 are open at the front end only.

The cover plate 30 is made of a material having higher Young's modulus than the piezoelectric materials comprised of the side walls 24, such as forsterite ($2MgO \cdot SiO_2$), beryllia (BeO), magnesia (MgO), almina ($Al_2O_3$), and zirconia ($Zro_2$). The Young modulus is $1.5 \times 10^6$ kg/cm$^2$ for forsterite, $3.5 \times 10^6$ kg/cm$^2$ for beryllia, $15 \times 10^6$ kg/cm$^2$ for magnesia, $3.85 \times 10^6$ kg/cm$^2$ for almina, and $1.61 \times 10^6$kg/cm$^2$ for zirconia. On the other hand, the Young modulus for PZT or PT is almost $0.0546 \times 10^6$ kg/cm$^2$. This elasticity prevents the cover plate 30 from deforming, and allows the side walls 24 to be deformed fully as expected.

An experiment shows that the side walls 24 and the cover plate 30 made of PZT or PT need a voltage of 16V to obtain a desired volume change of the ejection channel 21. However, when the cover plate 30 made of forsterite is used, the necessary voltage to obtain the same result is 14.7 V. In addition, the thickness of the cover plate 30 is enough for being almost equal or greater than that of the side walls 24 (approx. 50 $\mu$m).

PZT and PT have a specific gravity of 8, and forsterite has 2.8. This results in forsterite having the effect of saving weight in the ink jet head. Almina also has the same effect. Furthermore, the above-mentioned materials, from forsterite to zirconia, are more inexpensive than PZT and PT.

A nozzle plate 32 is bonded to the front ends 10*a,* 30*a* of the actuator board 10 and the cover plate 30 with an epoxy-base adhesive to seal against leakage. The nozzle plate 32 is provided with a plurality of nozzles 33 in one-to-one correspondence to each ejection channel 21 so as to allow it to jet ink droplets therefrom. A manifold 31 is bonded to the back ends of the actuator board 10 and the cover plate 30. The manifold 31 has an ink supply port 31 a to be connected to an ink tank, not shown. Ink is supplied to all ejection channels 21 via the ink supply port 31*a.*

The electrodes 26*a,* 26*b* are formed on the ejection channels 21 and the dummy channels 22 respectively (FIG. 2). The electrodes 26*a,* 26*b* are conductive layers to apply voltage to activate the actuator. The electrodes 26*a* are formed on each inner wall of the ejection channels 21 (on each side surface on the ejection channel side of the side wall 24), and connected to the common potential (ground). On the other hand, the electrodes 26*b* are formed on each inner wall of the dummy channels 22 (on each side surface on the dummy channel side of the side wall 24), independently of each other.

Figure 7:
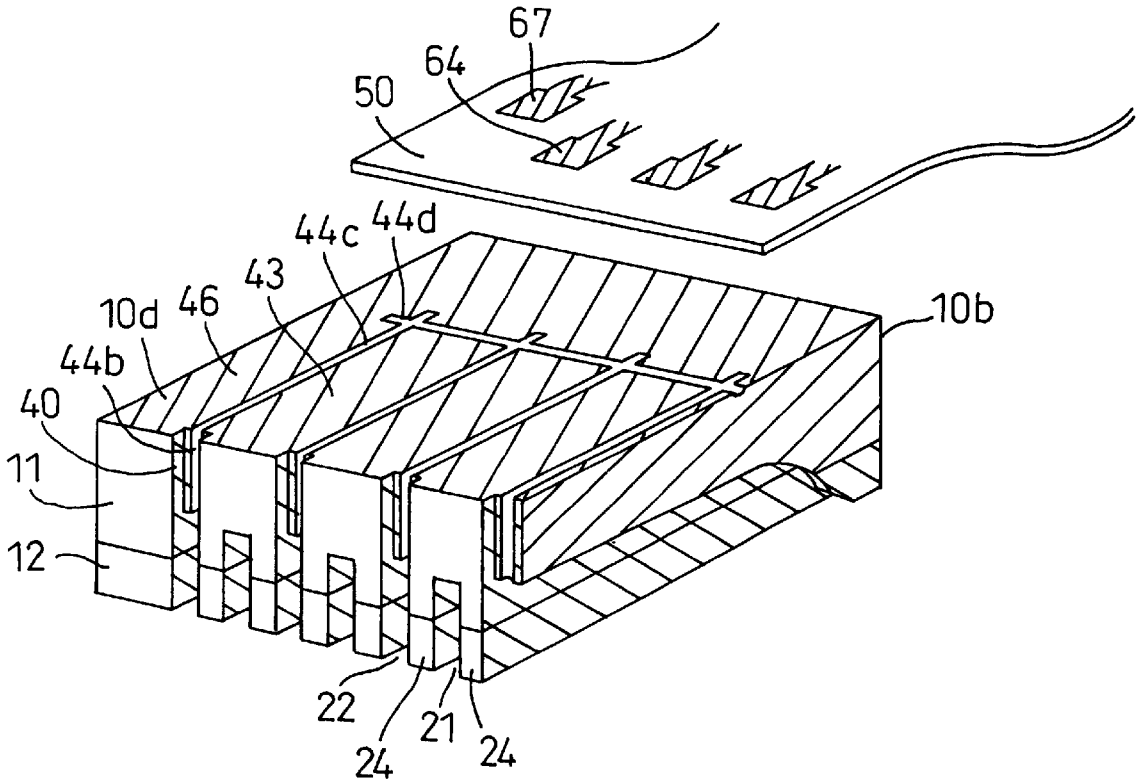
FIG. 7 is a perspective view of an undersurface of the actuator board.
Figure 8:
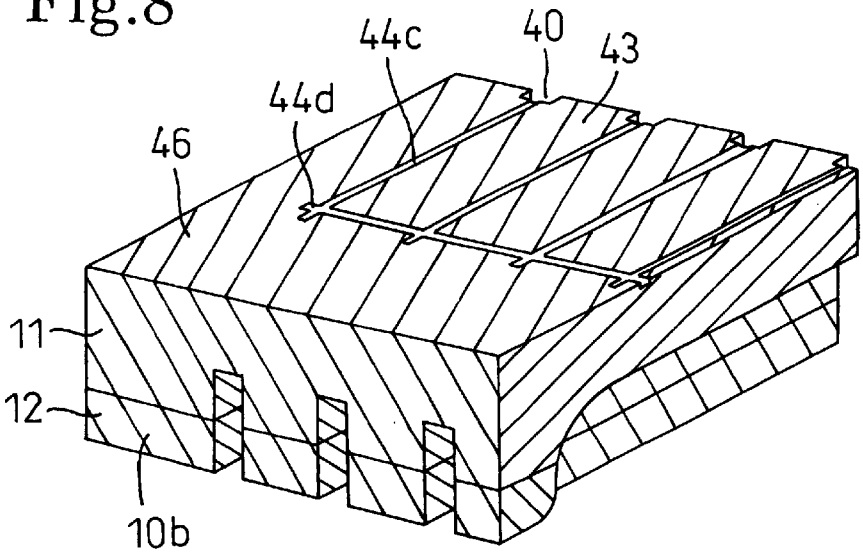
FIG. 8 is a perspective view of an undersurface of the actuator board viewed from the rear end.

As shown in FIGS. 7 and 8, a plurality (equaling the number of ejection channels 21) of connecting terminals 43, and a connecting terminal 46 on the common potential side are formed on the underside 10*d* of the actuator board 10. Each terminal 43 is connected, through the conductive layers of the two vertical grooves 40, to the two electrodes 26*b,* 26*b* which are outside of the both sides of the ejection channel 21. The terminal 46 is connected to the electrodes 26*a* in each ejection channel 21 via the conductive layer on the rear end 10*b* of the actuator board 10. A pattern cable to send a driving signal to each electrode, a flexible printed circuit board 50, includes a plurality of terminals 64 to be connected to the signal lines and a ground terminal 67. The terminals 64 are connected to the connecting terminals 43, and the terminal 67 is connected to the terminal 46, both by soldering. The other end of the flexible printed circuit board 50 is connected to a driving control part of an ink jet recording device (not shown). When the voltage is selectively applied to each of the terminals 43, an electric field whose electric force is orthogonal to the polarized directions is generated between the two electrodes 26*b,* 26*b* outside of the both sides of a selected ejection channel 21, and is applied to the next side walls 24, 24 at both sides. As a result, the side walls 24, 24 deflect the ejection channel 21 in a direction that the volume of the ejection channel 21 is increased. When the side walls 24, 24 are returned to their original positions by the interruption of the voltage, a pressure is applied to the ink in the ejection channel 21, allowing ink droplets to jet out from the nozzle 33.

The ink jet head having the above structure is produced by a producing method described below, which is explained with reference to FIGS. 4 to 8.

Figure 4:
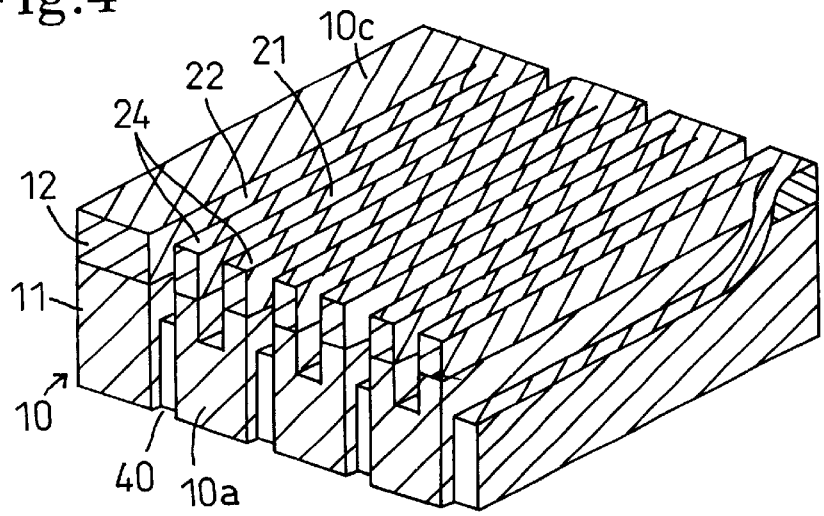
FIG. 4 is a perspective view of an actuator board in a manufacturing process.
Figure 5:
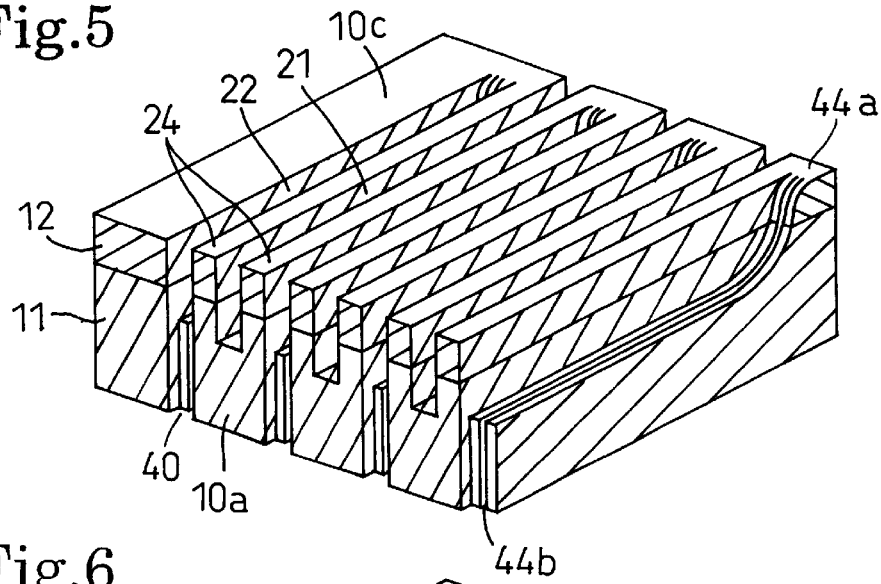
FIG. 5 is a perspective view of the actuator board in a manufacturing process.
Figure 6:
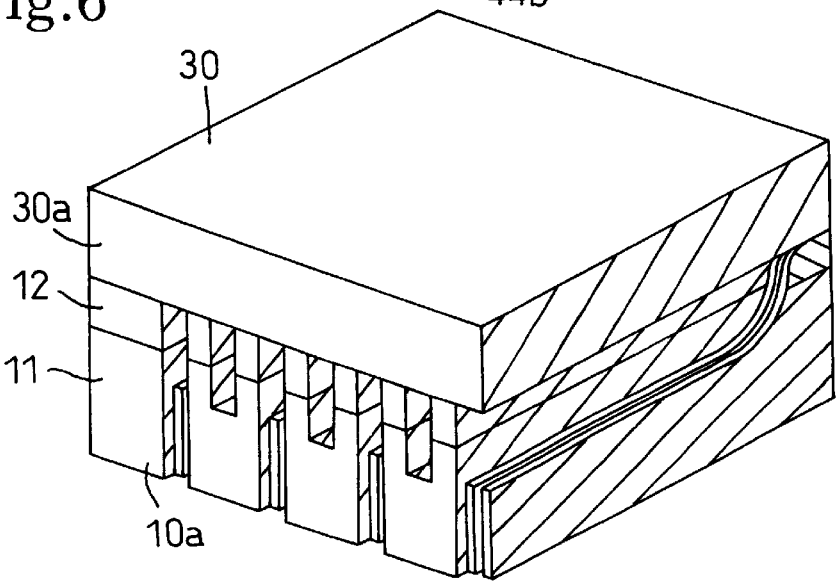
FIG. 6 is a perspective view of the actuator board in a manufacturing process.

A plate made of laminated piezoelectric materials is vertically sliced to form the actuator board 10. Then, the ejection channels 21, the dummy channels 22, and the vertical grooves 40 are cut out on the actuator board 10 using diamond blade (FIG. 4). Then, the conductive layer (black-colored portions in FIG. 4) is formed on the entire surfaces of the actuator board 10 including the ejection channels 21, the dummy channels 22, the vertical grooves 40, the rear end 10*b,* and the underside 10*d,* by physical vapor deposition or electroless plating. (The conductive layer will be described later in detail.) The top surface 10*c* of the actuator board 10 is cut or ground to eliminate the conductive layer (white portions in FIG. 5) from the top surface 10*c.* This elimination divides the conductive layer according to channels 21, 22 at the top surface 10*c.* Accordingly, the electrode 26*a* is formed on the inner surface of each ejection channel 21.

The center of the bottom surface of each dummy channel 22 is radiated with a laser, which forms a first divisional groove 44*a* from the front end to the top rear end where there is no conductive layer. Accordingly, the two discrete electrodes 26*b,* 26*b* are formed on the inner surface of each dummy channel 22. In each vertical groove 40 connected to the dummy channels 22, a second divisional groove 44*b* which is joined to the first groove 44*a,* is formed.

Further, on the underside 10*d* of the actuator board 10, as shown in FIG. 7, a plurality of third divisional grooves 44*c,* joined to each second groove 44*b,* are formed in parallel to each dummy channel 22 from the front end to the vicinity of the rear end. A forth divisional groove 44*d* is formed near the end of each third groove 44*c* intersecting at right angles.

This allows grooves 44*c* and 44*d* to form the connecting terminals 43 in parallel, and the connecting terminal 46 around the terminals 43 on the underside 10*d* of the actuator board 10. Regarding one ejection channel 21 and the two side walls 24 as one actuator, each terminal 43 is connected to the electrodes 26*b,* 26*b* on the dummy channels 22 surrounding the actuator via the conductive layer in the vertical grooves 40. In other words, each actuator functions independently because of divisional grooves 44*a* to 44*c*. The terminal 46 on the common potential side is connected to the electrode 26*a* in the ejection channel 21 via the conductive layer on the rear end 10*b* of the actuator board 10.

Then, the cover plate 30 is joined to the top of the actuator board 10 as described above. The front ends 10*a,* 30*a* of the actuator board 10 and the cover plate 30 are cut or ground, to eliminate the conductive layer from the front ends 10*a,* 30*a* (white portions in FIG. 6). The nozzle plate 32 is bonded to the front end 10*a* so that the nozzles 33 of the cover plate 30 correspond to the ejection channels 21. The manifold 31 is joined to the rear end 10*b.* Then, the flexible printed circuit board 50 is connected to the underside 10*d* of the actuator board 10 so that terminals 64 and 67 are aligned with terminals 43 and 46. Those terminals are soldered. They are assembled as an ink jet head. It is noted that the solder layers are formed on the terminals 64 and 67 on the flexible printed circuit board 50 in advance, melt by application of heat, and adhered to terminals 43 and 46 respectively.

A structure and a producing method for electrodes 26*a* and 26*b* which are formed on the ejection channels 21 and the dummy channels 22 will be now described. Ink directly wets at least the electrode 26*a* for the ejection channel 21. Therefore, the electrodes 26*a*, 26*b* are made of a noble metal with high corrosion resistance, and they have the two-layer structure. A first layer of the electrodes is made of a noble metal containing phosphorus or boron, for example, palladium including phosphorus because it is formable directly on PZT of the actuator board 10. A second layer formed on the first layer is made of a noble metal, for example, pure palladium, with low resistance. Pure palladium has a purity of approximately 99.5% or more.

The first layer can be easily formed on the actuator board 10 by electroless plating or physical vapor deposition, and the second layer by electroless plating, electroplating, or physical vapor deposition. The two-layer electrodes can be formed as a conductive layer continuing at least from the ejection side to the opposite side of the actuator board 10.

The noble metal containing phosphorus or boron aids to form a layer directly on a piezoelectric element, such as PZT of the actuator board 10, but its resistance is comparatively high. On the other hand, the noble metal is difficult to form a layer directly on the piezoelectric element, but is easy to form a layer on the noble metal containing phosphorus or boron. In addition, its resistance is low. The invention makes use of the above two features to structure the two-layer electrode. This structure of the electrode improves corrosion resistance to ink, eliminates the necessity to form a conventional protective layer, thereby reducing the number of manufacturing steps and costs.

In addition, the pattern cable is connected to a connecting terminal on the second layer of the electrode having a low resistance, resulting in reduction of the workload at the driving control part. An electrode having the two layers made of different metals causes a difference in electric potential in the boundary between the two layers, which are easily susceptible to corrosion. However, the invention uses an electrode using the same metal (palladium) for the two layers, and such problem can be resolved.

Figure 9:
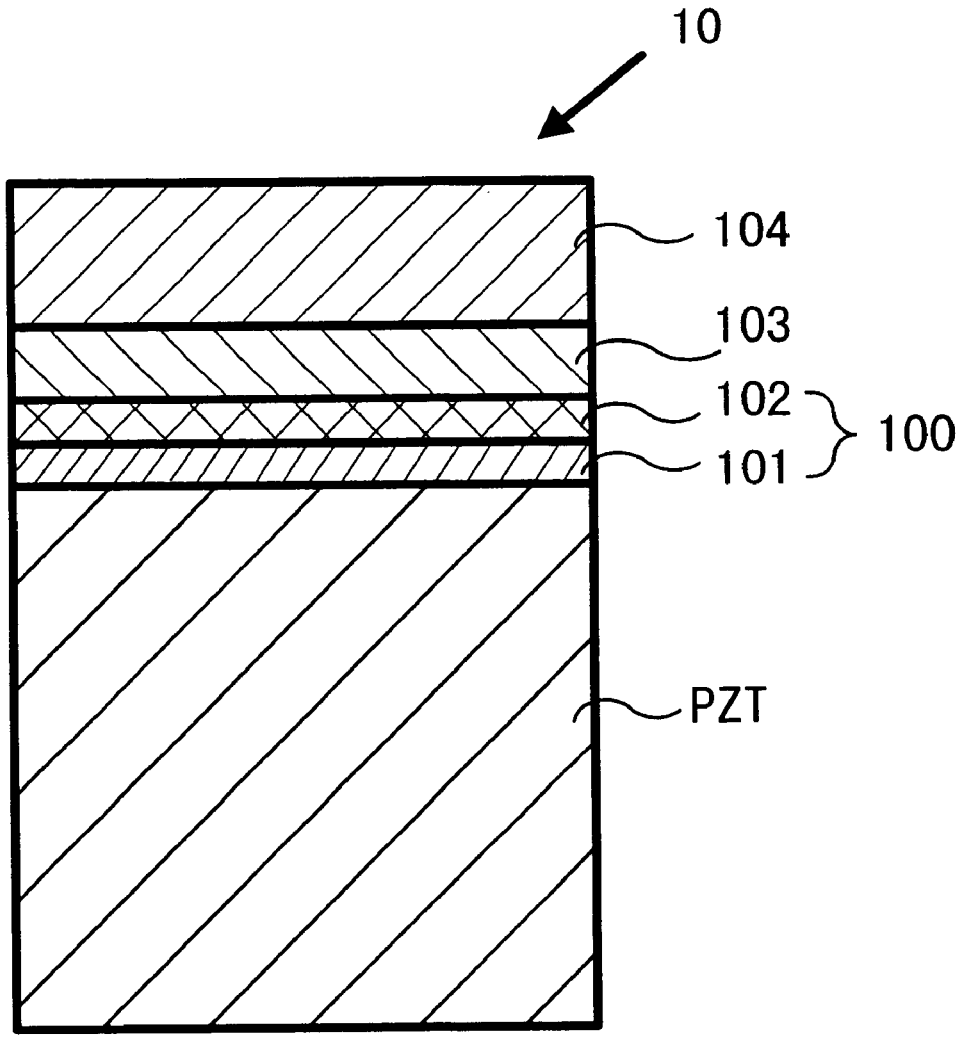
FIG. 9 is a sectional view of a two-layer electrode formed on the actuator board.

FIG. 9 shows a detailed structure of the two-layer electrode. In this embodiment, on the surface of PZT that is the actuator board 10, a catalyst metal particle layer 100 comprised of a tin ion particle layer 101(with a thickness of approx. 0.1 nm to 1.0 nm) and a palladium particle layer 102(with a thickness of approx. 0.1 nm to 1.0 nm) is formed by precipitation. On the catalyst layer 100, a palladium-phosphorus plating layer 103 as the first layer (with a thickness of approx. 0.1 $\mu$m), and a pure palladium plating layer 104 as the second layer (with a thickness of approx. 0.1 $\mu$m) are formed. Thus, the precipitation of the catalyst layer 100 on PZT aids to form the first layer made of noble metal containing phosphorus or boron, such as palladium containing phosphorus, as a plating layer by precipitation.

Figure 10:
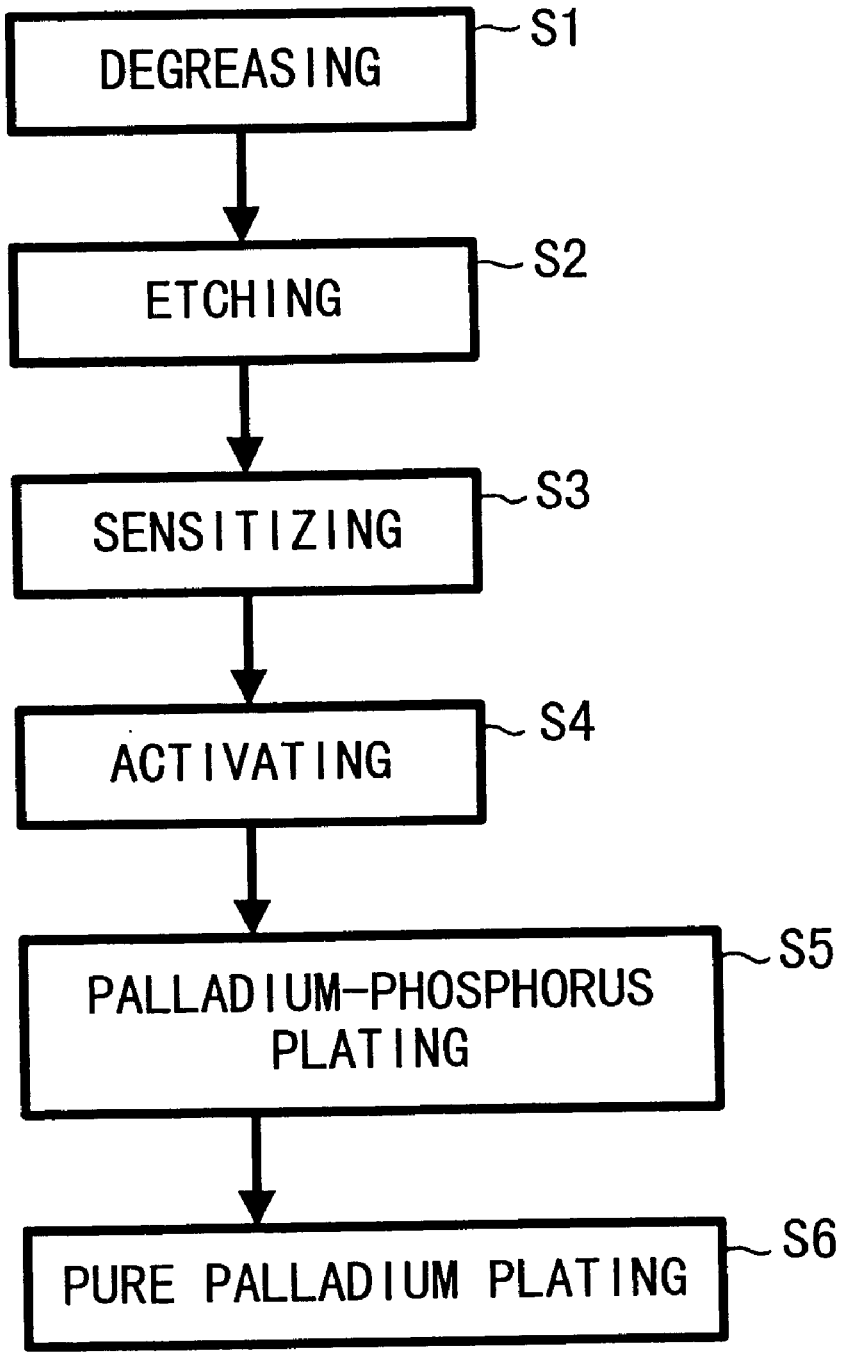
FIG. 10 shows a manufacturing process of the two-layer electrode.

FIG. 10 shows steps to form the catalyst metal particle layer and the two palladium plating layers. The PZT surface on the actuator board 10 is washed and degreased (S1). The actuator board 10 is etched using acid to form microscopic asperities on the surface (etching; S2). The board 10 is dipped in a tin chloride water solution, and tin ions absorb on the surface (sensitizing; S3). The board 10 is dipped in a palladium chloride water solution and palladium is precipitated via the reducing power of the tin ions (activating; S4). The board 10 is dipped in a plating liquid of palladium containing phosphorus, electroless plating is carried out therein, a palladium-phosphorus plating layer as the first layer is precipitated on the nucleuses of palladium (S5). Further, the board 10 is dipped in a plating liquid of palladium, electroless plating is carried out therein, and a palladium plating layer as the second layer is precipitated on the first layer (S6). If a plating layer is formed on the PZT surface using an electroless plating liquid, the first layer is not formed because PZT includes lead, which acts as a catalytic poison. If procedure is shifted from S4 to S6 directly, the second layer is not precipitated. However, the above sequence of steps enables the formation of a palladium layer with low resistance. For the second layer, the plating layer may be formed by dipping in a palladium plating liquid and by supplying power.

As to conductive layer materials of an electrode, the invention is not limited to the above examples. Any metals having the same kind of properties as those used for the first and second layers, such as gold or rhodium, can be used. The invention can be applied not only to an ink jet head where ink is jetted by deforming walls of the ejection channels 21 but also to other type head, for example, a thermal type ink jet head where the power is supplied to an actuator for jetting ink.

What is claimed is:

1. An ink jet head, comprising:

an actuator board formed with a plurality of ejection channels for jetting ink droplets out therefrom; and a plurality of electrodes provided on the actuator board so as to provide energy to eject ink from the ejection channels;

wherein each of the plurality of electrodes comprises:

a first layer made of a noble metal being formed on the actuator board; and a second layer that includes the noble metal and has a lower electrical resistance than the first layer, the second layer being formed on the first layer.

2. The ink jet head according to claim 1, wherein the first layer is formed of palladium and at least one of phosphorus and boron.

3. The ink jet head according to claim 2, wherein the actuator board has a catalyst metal particle layer formed thereon, and the catalyst metal particle layer forms the first layer thereon.

4. The ink jet head according to claim 2, wherein the first layer is formed by electroless plating or physical vapor deposition.

5. The ink jet head according to claim 1, wherein the second layer is formed of substantially pure palladium.

6. The ink jet head according to claim 5, wherein the substantially pure palladium has a purity of approximately 99.5% or more.

7. The ink jet head according to claim 5, wherein the second layer is formed by electroless plating, electroplating, or physical vapor deposition.

8. The ink jet head according to claim 1, wherein the ejection channels of the actuator board are defined with walls of a piezoelectric material electrically polarized in at least one part, the electrodes being formed on sides of the walls.

9. The ink jet head according to claim 8, the ink jet head further comprising a connecting terminal to connect each electrode formed on a surface of the actuator board opposite to the surface of the ejection channels, to a signal source.

10. An ink jet head, comprising:

an actuator board having a plurality of channels defined by side walls made of a piezoelectric material electrically polarized in at least one part, the channels each having an open face disposed in a longitudinal direction;

an electrode formed on a surface of the side walls parallel to a polarized direction, the electrode generating an electric field orthogonal to the polarized direction so as to deform the side walls in a direction of the channel width; and a cover plate that covers the open faces of the channels, the cover plate being fixed to the side walls, wherein the cover plate is made of one of forsterite and beryllia.

11. The ink jet head according to claim 10, comprising:

at least one other electrode provided on the actuator board, wherein the electrode and the at least one other electrode each include:

a first layer made of a noble metal being formed on the actuator board; and a second layer that includes the noble metal and has a lower electrical resistance than the first layer, the second layer being formed on the first layer.

12. The ink jet head according to claim 11, wherein the channels of the actuator board are defined with walls of a piezoelectric material electrically polarized in at least one part, the electrodes being formed on sides of the walls.

13. The ink jet head according to claim 12, the ink jet head further comprising a connecting terminal to connect each electrode formed on a surface of the actuator board opposite to the surface of the channels, to a signal source.

14. The ink jet head according to claim 11, wherein the first layer is formed of palladium and at least one of phosphorus and boron.

15. The ink jet head according to claim 14, wherein the actuator board has a catalyst metal particle layer formed thereon, and the catalyst metal particle layer forms the first layer thereon.

16. The ink jet head according to claim 14, wherein the first layer is formed by at least one of electroless plating, electroplating, and physical vapor deposition.

17. The ink jet head according to claim 11, wherein the second layer is formed of substantially pure palladium.

18. The ink jet head according to claim 17, wherein the substantially pure palladium has a purity of approximately 99.5% or more.

19. The ink jet head according to claim 17, wherein the second layer is formed by at least one of electroless plating, electroplating, and physical vapor deposition.

* * * * *